US007891040B2

(12) United States Patent
Christie

(10) Patent No.: US 7,891,040 B2
(45) Date of Patent: Feb. 22, 2011

(54) GUTTER CLEANING DEVICE AND GUTTER CLEANING PAIL SYSTEM

(76) Inventor: William L. Christie, 1501 E. Sleepy Hollow Dr., Olathe, KS (US) 66062-2263

( * ) Notice: Subject to any disclaimer, the term of this patent is extended or adjusted under 35 U.S.C. 154(b) by 708 days.

(21) Appl. No.: 11/852,966

(22) Filed: Sep. 10, 2007

(65) Prior Publication Data

US 2008/0060160 A1 Mar. 13, 2008

Related U.S. Application Data

(60) Provisional application No. 60/885,078, filed on Jan. 16, 2007, provisional application No. 60/825,161, filed on Sep. 11, 2006.

(51) Int. Cl.
*A47L 13/08* (2006.01)
*E04D 13/076* (2006.01)

(52) U.S. Cl. ..... 15/236.04; 15/264

(58) Field of Classification Search ..... 15/236.04, 15/236.01, 236.05, 236.06, 236.09, 264, 15/104.8, 257.01, 257.1; 294/19.1
See application file for complete search history.

(56) References Cited

U.S. PATENT DOCUMENTS

| | | | | |
|---|---|---|---|---|
| 3,023,971 | A * | 3/1962 | Milhous | 401/137 |
| 3,858,267 | A * | 1/1975 | Swannie | 15/236.04 |
| 5,273,160 | A * | 12/1993 | Malvasio | 206/362 |
| 5,288,118 | A * | 2/1994 | Hartselle, III | 294/19.1 |
| 6,842,937 | B2 * | 1/2005 | Li | 15/236.04 |
| 2003/0051305 | A1 * | 3/2003 | Hewlett | 15/236.04 |
| 2003/0168464 | A1 * | 9/2003 | Terenzoni | 220/751 |
| 2009/0293217 | A1 * | 12/2009 | Paterson | 15/236.04 |

* cited by examiner

*Primary Examiner*—Monica S Carter
*Assistant Examiner*—Stephanie Newton
(74) *Attorney, Agent, or Firm*—Law Office of Mark Brown, LLC; Mark E. Brown

(57) ABSTRACT

A gutter cleaning device includes handle and head portions and is adapted for use with a gutter cleaning pail system. The gutter cleaning device head portion is configured to slide within the interior of a gutter and has a configuration generally corresponding to the cross-sectional shape of the gutter interior. The gutter cleaning pail system includes a mounting assembly for mounting on a gutter.

4 Claims, 6 Drawing Sheets

GUTTER CLEANING DEVICE AND GUTTER CLEANING PAIL SYSTEM

CROSS-REFERENCE TO RELATED APPLICATION

This application claims the benefit of U.S. Provisional Applications No. 60/885,078 Jan. 16, 2007 and No. 60/825,161 Sep. 11, 2006, which are incorporated by reference herein in their entireties.

BACKGROUND OF THE INVENTION

In many locations throughout the world, organic debris such as deciduous leaves, pine needles and moss present a continuous source of material which falls upon the roofs of houses. Such material ultimately is transported via wind and rain into the gutters causing damage to their structure and requiring continuous maintenance of the system. In addition to rendering the gutters and downspouts ineffective for channeling water from the roof, the accumulation of debris within the gutters can create more serious problems for the homeowner or building owner, including that of substantial damage to the roof and gutters which will result from the weight of standing water remaining in the gutters. Presently, there are several methods for eliminating accumulated debris. One method employs screens or permeable drain covers. Though this method usually requires little upkeep once installed, these covers merely act as a ramp to transfer the debris onto shrubbery, walkways and flower beds. Additionally, even permeable covers become clogged and periodically require removal and cleaning. Another method involves complicated water cleaning devices that are generally costly. A simplified, affordable device is necessary to provide a reasonable way to clean and maintain gutters.

SUMMARY OF THE INVENTION

In the practice of an aspect of the present invention, a gutter cleaning device and gutter cleaning pail system are provided. The gutter cleaning device includes a handle portion adapted for placement in a gutter and a head portion adapted for grasping by a user in order to advance the gutter cleaning device along the interior of a gutter. A gutter cleaning pail system includes a sleeve adapted for receiving and storing the gutter cleaning device, and also includes mating structures for mounting the pail in an easily-accessible position alongside and supported by a gutter.

DETAILED DESCRIPTION OF THE PREFERRED EMBODIMENTS

Figure 1:
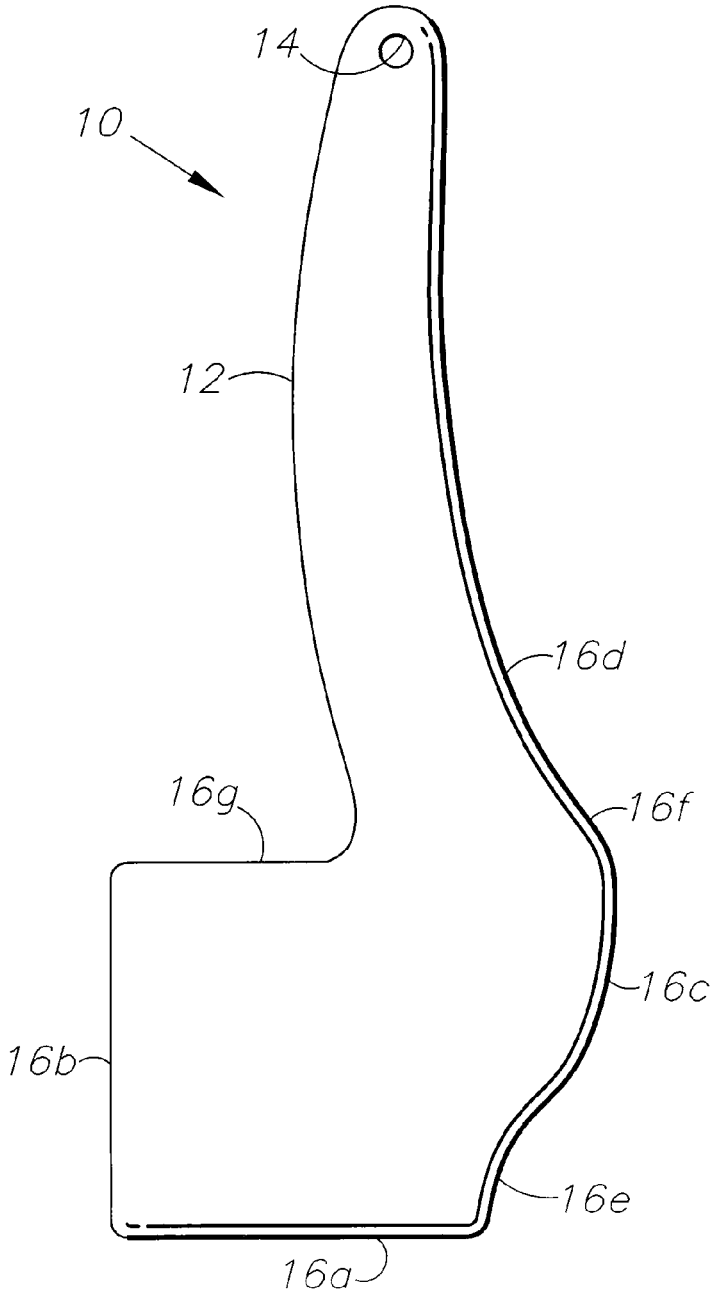
FIG. 1 is a front, three-dimensional view of a gutter cleaning device, in accordance with the present invention.

Certain terminology will be used in the following description for convenience in reference only and will not be limiting. For example, up, down, front, back, right and left refer to the invention as oriented in the view being referred to. The words "inwardly" and "outwardly" refer to directions toward and away from, respectively, the geometric center of the embodiment being described and designated parts thereof. Said terminology will include the words specifically mentioned, derivatives thereof and words of similar meaning.

Referring to the drawings in more detail, the present invention includes a gutter cleaning device and gutter cleaning pail system. The gutter cleaning device 10, as shown in FIG. 1, can be used in combination with a gutter cleaning pail 20 as shown in FIG. 2.

Figure 2:
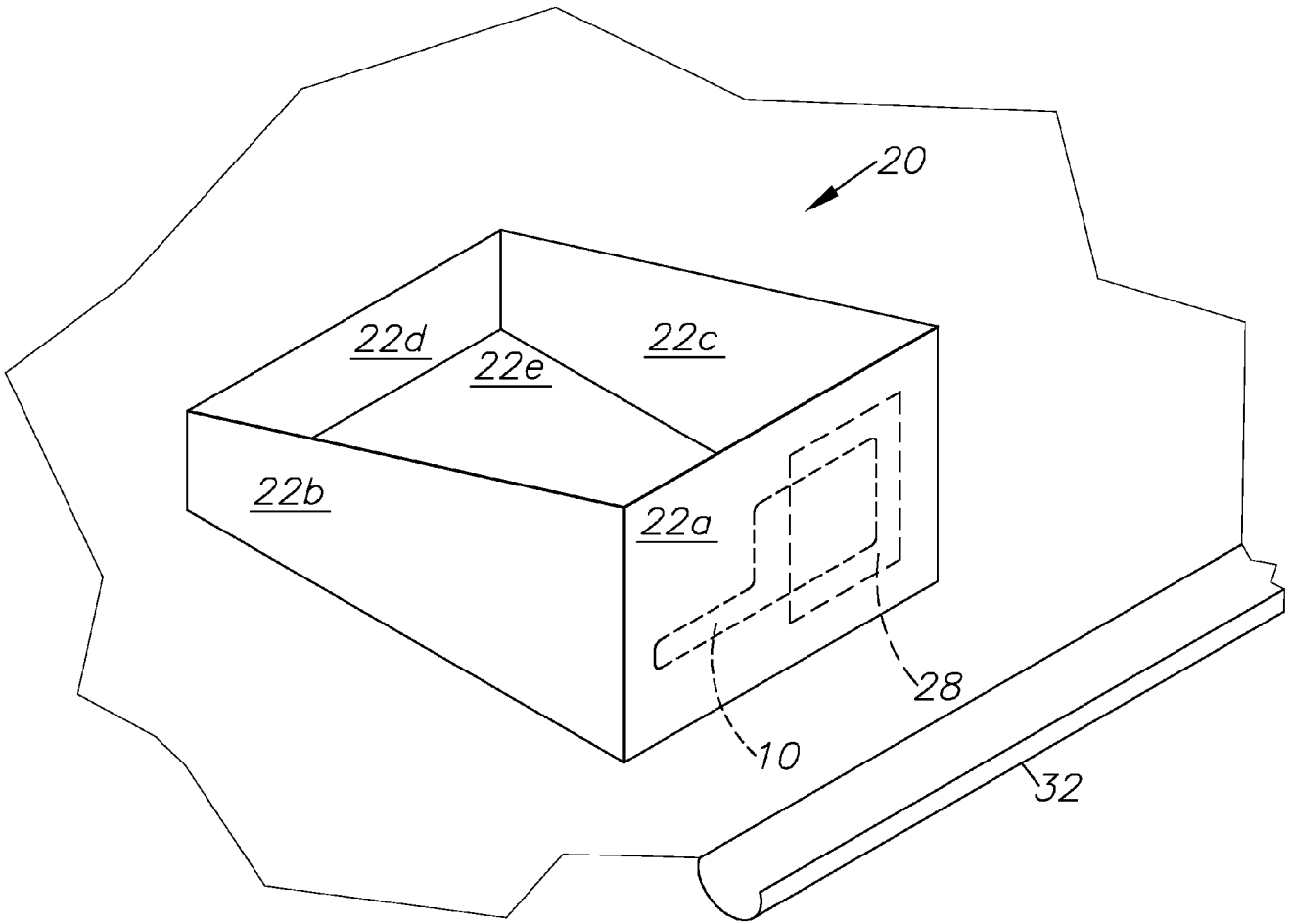
FIG. 2 is a front, three-dimensional view of a combination gutter cleaning device and gutter cleaning pail system, in accordance with the present invention.

FIG. 1 illustrates the gutter cleaning device 10 of the present invention. Gutter cleaning device 10 may be constructed of any material, generally plastic so that it will not scratch or mar the interior of a gutter secured below the edges of a roof. Gutter cleaning device 10 is preferably constructed of one piece of material and can be any useful thickness such as about ⅛ to about ½ inch thick and typically about ¼ inch thick. Gutter cleaning device 10 can be used with common K-style 5 inch and 6 inch gutters, and with gutters having a wide variety of other configurations.

Figure 1A:
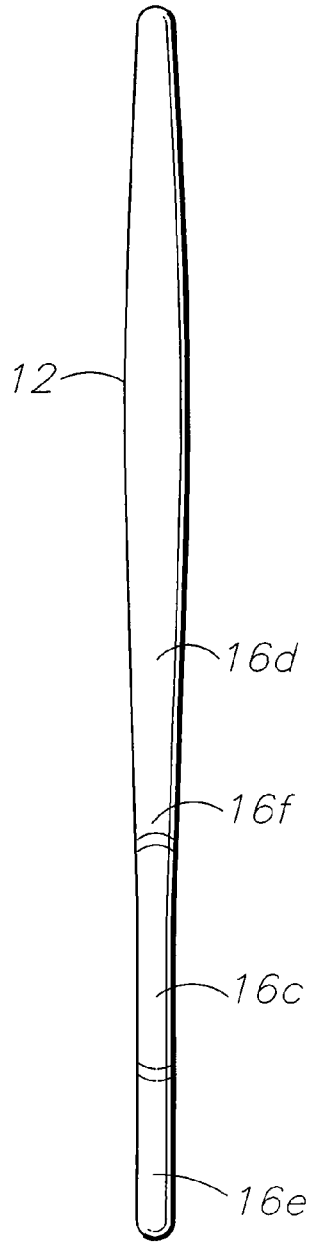
FIG. 1A is a side elevational view of a gutter cleaning device, in accordance with the present invention.

Gutter cleaning device 10 includes a handle portion 12 extending from a head portion 16 designed to extend beyond the gutter when the device is being used so that it can be comfortably held by a user. Handle portion 12 may have a tapered design to promote rigidity (FIG. 1A). An optional hole 14 through one end of handle 12 may be threaded with rope or lanyard to hang the gutter cleaning device 10.

Figure 4:
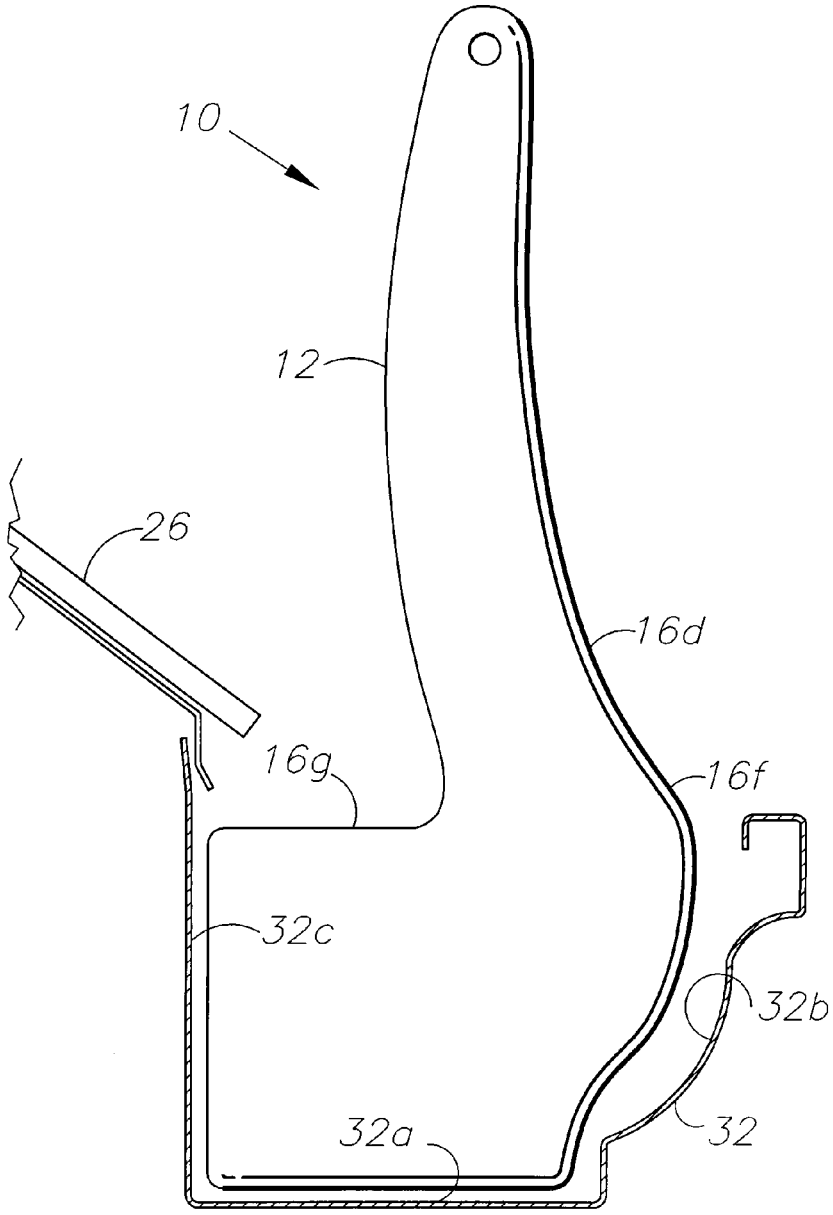
FIG. 4 is a side view of the gutter cleaning device in use, in accordance with the present invention.

The head portion 1 of gutter cleaning device 10 has a bottom surface 16*a* adapted to move along the bottom, interior surface of a conventional 5" or 6" universal aluminum gutter 32, as shown n FIG. 4. The head portion 16 further has a rear surface 16*b* adapted to move along the rear, inner wall of a gutter. The head portion 16 further has a forward surface 16*c* adapted to move along the front, inner wall of a gutter. An upper, forward surface 16*d* of the forward surface 16*c* intersects the lower side of handle 12. A lower portion 16*e* of the forward surface 16*c*, beginning at the bottom surface 16*a*, curves upward to form a humped shape portion 16*f* that is designed to correspond with the forward, inner surface of the gutter 32. Also, the portion 16 has an upper surface 16*g* between handle portion 12 and rear surface 16*b* which is spaced from the bottom surface 16*a* a distance so that it can fit beneath roof shingles that can extend from the interface of the roof and the side of a house. The handle portion 12 is designed to provide clearance from the edges of the adjacent roofing shingles, which can extend one or more inches from the roof line depending upon the size of the gutter, the presence of additional layers of shingles from reroofing, and other factors. Gutter cleaning device 10 is also designed to slide under gutter spikes to continue moving debris for easy removal from a gutter.

FIG. 2 illustrates the combination of the gutter cleaning device 10 and the gutter cleaning pail 20. Gutter cleaning pail 20 may be constructed of any material, generally plastic for its light weight. Gutter cleaning pail 20 has the primary purpose of holding the debris collected with gutter cleaning device 10.

Also, gutter cleaning pail 20 stores the gutter cleaning device 10 while ascending and descending the ladder. Between uses, the gutter cleaning device 10 and gutter cleaning pail 20 are stored together for convenience so that they are ready for use as needed. Gutter cleaning pail 20 consists of four walls 22*a*, 22*b*, 22*c*, and 22*d* and a floor 22*e*. The floor 22*e* may be of any dimensions or shape such as, for example, a 12×12 inch square shape. The walls 22*a*, 22*b*, 22*c*, and 22*d* may be of any dimensions, but it is preferred that wall 22*a* is taller than the opposite facing wall 22*d*. This results in the walls 22*b* and 22*c*, which connect wall 22*a* to opposite facing wall 22*d*, having an upward slope from wall 22*d* to wall 22*a*. This slope on the bottom of gutter cleaning pail 20 keeps it straight and better balanced while sitting on the roof 26, as shown in FIG. 2. Additionally, the gutter cleaning pail 20 is designed to remain on the roof 26 without a person having to hold it stationary. This makes it easier to clean the gutter and also decreases the time of the gutter cleaning process. A possible arrangement could be that 22*a* is 6 inches high and 22*d* is 2 inches high.

Figure 3:
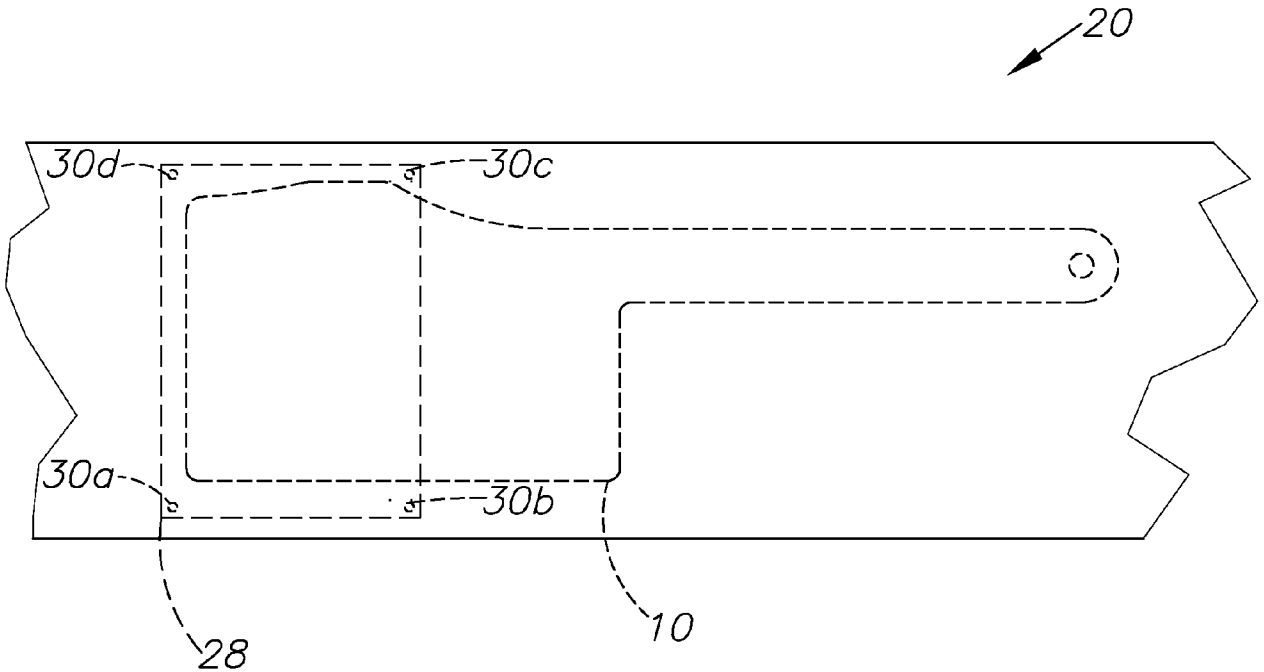
FIG. 3 is a side view of the gutter cleaning device attached to an inner side wall of the gutter cleaning pail, in accordance with the present invention.

As shown in FIGS. 2 and 3, there is a holster 28 that may be attached to an interior surface of any wall of gutter cleaning pail 20, such as wall 22*a* in FIG. 2 or wall 22*b* in FIG. 3. Holster 28 is used to sheath gutter cleaning device 10. This prevents the user from needing a tool belt or having to hold the cleaning device 10 while doing other tasks. Also, it is convenient to store the tool device 10 in the pail until the next time it is needed.

FIG. 3 is a detailed view of the gutter cleaning device 10 sheathed in the holster 28 on the interior surface of wall 22*b* gutter cleaning pail 20. Holster 28 is attached to wall 22*b* by means of any desired connectors 30*a*, 30*b*, 30*c*, and 30*d*. such as rivets, screws, and nuts and bolts.

FIG. 4 illustrates gutter cleaning device 10 within gutter 32 attached to the side wall 34 of a house and below a sloping roof 36. Gutter 32 consists of a bottom interior surface 32*a*, a forward inner wall 32*b*, and a rear inner wall 32*c*. As described above the gutter cleaning device 10 is shaped to generally correspond to the inner dimensions of the gutter 32 to enable the user to move the maximum amount of debris with each sweep through the gutter. Also, note that gutter cleaning device 10 is shaped to accommodate the roofing shingles extending beyond the side wall 34.

Figure 5:
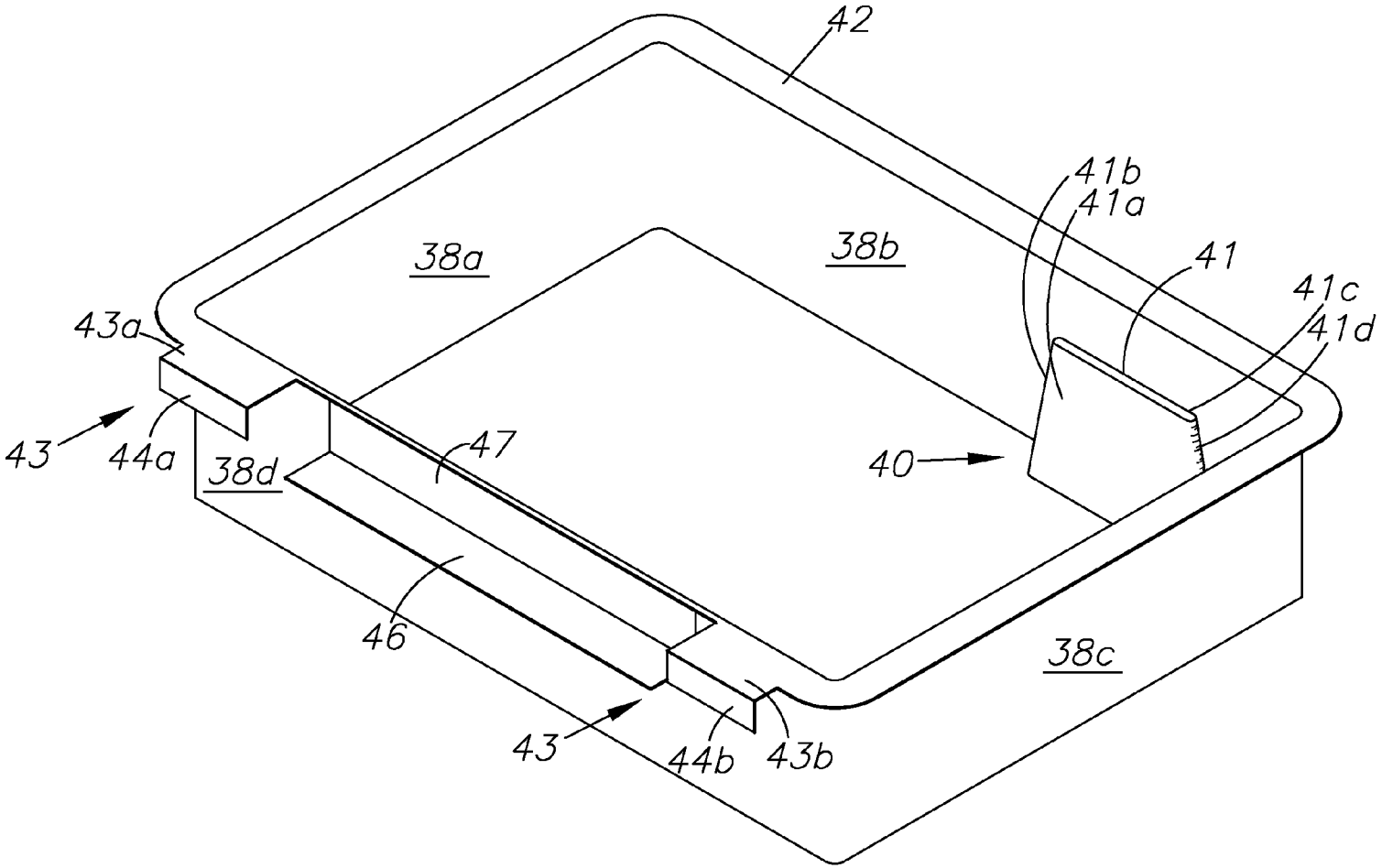
FIG. 5 is a three-dimensional view of another embodiment of a gutter cleaning pail system, in accordance with the present invention.

FIG. 5 illustrates another embodiment of a gutter cleaning pail system 36. Gutter cleaning pail 36 may be constructed of any material, generally plastic for its light weight. Gutter cleaning pail 36 consists of four sidewalls 38*a*, 38*b*, 38*c*, and 38*d* and a bottom floor 38*e*. The floor 38*e* may be of any dimensions or shape such as, for example, a 10 inch×12 inch rectangular shape. The sidewalls 38*a*, 38*b*, 38*c*, and 38*d* may be of any dimensions or shape such as, for example, a 10 inch×12 inch rectangular shape. The gutter cleaning pail 36 is designed to remain relatively level with the gutter 32 to which it is clipped whereby a worker can utilize both hands for cleaning and debris removal without having to hold on to the cleaning pail 36. The closely adjacent proximity of the gutter cleaning pail 36 to the gutter 32 minimizes the distance debris must be moved during cleaning operations, which provides safety advantages.

Separated from sidewall 38*b* is a freestanding sleeve 40 that is attached to and extends upward from the bottom floor 38*e*. Sleeve 40 may be an integral part of pail 36 and be constructed of the same material such as plastic. The sleeve 40 has an inner, oblong shaped cavity 41 that is designed to receive and store the gutter cleaning device 10. Sleeve 40 is constructed of four sidewalls 41*a*, 41*b*, 41*c*, and 41*d* that are adjoined together to form cavity 41. Sidewalls 41*a* and 41*c* are of equal dimensions and are joined together by sidewalls 41*b* and 41*d*, which are of equal dimensions. The shape of head portion 16 of gutter cleaning device 10 allows it to be inserted into the cavity 41 of sleeve 40. Storing the gutter cleaning device 10 in sleeve 40 allows the user to perform various tasks, especially while standing on a ladder, without needing a tool belt or having to hold the cleaning device 10. Also, it is convenient to store the tool device 10 in the pail 36 until the next time it is needed. As shown in FIG. 5, there is a rim 42 that is integrally formed with and extends perpendicularly outward from the open end of sidewalls 38*a*, 38*b* and 38*c*.

The embodiment shown in FIG. 5 includes two substantially similar mounting structures 43 that are spaced from each other. Each of the mounting structures 43 includes an extension element 43*a*, 43*b* that is integrally formed with and extends perpendicularly outward from the open end of sidewall 38*d*, preferably one of the longer sidewalls of pail 36. Each of the mounting structures 43 includes further gripping portions 44*a* and 44*b* that are integrally formed from the free edge of extension elements 43*a*, 43*b*, respectively. Gripping portions 44*a* and 44*b* extend substantially perpendicular to extension elements 43*a*, 43*b* and downward in the direction of the bottom floor 38*e*.

Figure 6:
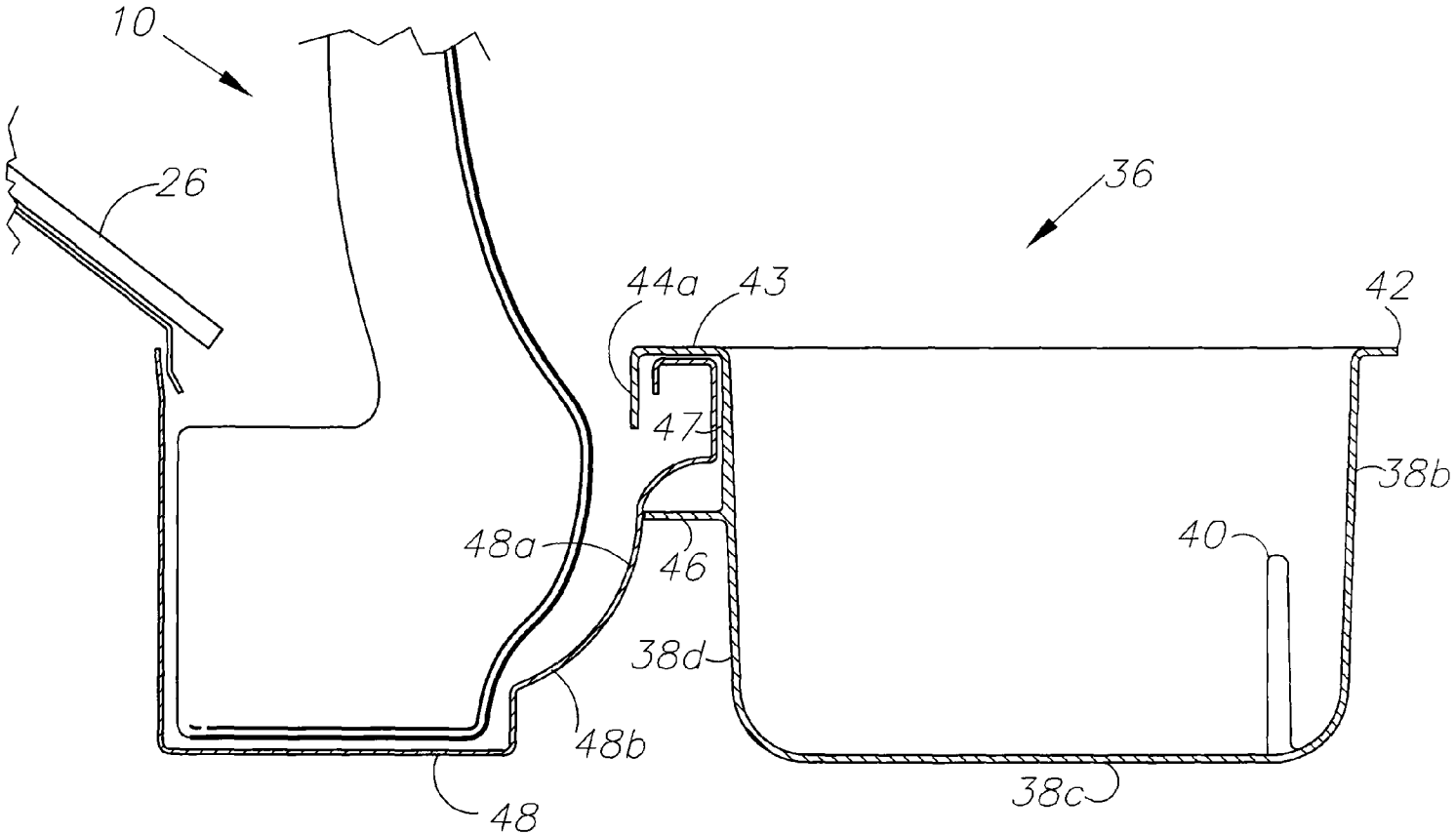
FIG. 6 is a side view of another embodiment of the gutter cleaning pail system in use in accordance with the present invention.

Referring again to FIG. 5, there is a stabilizing bar 46 between mounting structures 43 and extending substantially perpendicularly outward from sidewall 38*d*. As shown in FIG. 6, the stabilizing bar has substantially the same width as the width of extension elements 43*a* and 43*b*. It is within the terms of the present invention to increase the thickness of gutter cleaning pail 36 in the portion 47 above and/or below stabilizing bar 46.

It is within the terms of the present invention that gutter cleaning pail 36 be constructed without the sleeve 40 and accommodate various objects such as, for example, Christmas lights, which one wants to take up a ladder against the side of a house.

FIG. 6 illustrates a side view of the other embodiment of gutter cleaning pail 36 in use. The gripping portions 44*a* and 44*b* (not shown) of the extension elements 43*a* and 43*b* grip the inner side 48*a* of gutter 48 and the stabilizing bar 46 is disposed against the outer side 48*b* of the gutter 48 to provide solidity. Note that the stabilizing bar 46 is disposed on the sidewall 38*d* so that it contacts a universal gutter towards the middle of the outer side 48*b*. The gutter 48 shown in FIG. 6 is a relatively common K-style gutter, which is commonly produced in 5 inch and 6 inch sizes. However, the present invention can accommodate a wide range of gutter styles. For example, the gutter cleaning device head portion 16 can be shaped to accommodate the interior, cross-sectional configurations and sizes of a wide variety of gutters.

In another embodiment, a gutter cleaning pail can be designed to mount securely to a gutter.

In addition, a gutter cleaning pail can include a sleeve with an inner, oblong shaped cavity to receive and store a gutter cleaning device.

It is to be understood that the invention can be embodied in various forms, and is not to be limited to the examples discussed above. Other components and configurations can be utilized in the practice of the present invention.

Having thus described the invention, what is claimed as new and desired to be secured by Letters Patent is:

1. A gutter cleaning device and gutter cleaning pail system, which comprises:

a gutter cleaning device with a handle portion having a generally arcuate configuration and a head portion, said head portion forming a coplanar connection with the handle portion, said head portion including multiple surfaces configured to correspond to the cross-sectional shape of the interior of a gutter being cleaned, and said device adapted for removing debris from a gutter through a sweeping motion;

a pail including sidewalls and a bottom floor forming an upwardly-open cavity, said pail having a generally rectangular configuration;

a sleeve extending upwardly from said bottom floor in closely-spaced, generally parallel relation to a first respective sidewall and forming a cavity therebetween for receiving said gutter cleaning device in a secured storage position thereof;

the cavity shape formed by said sleeve and said first respective sidewall corresponding to the head of said gutter cleaning device;

the gutter cleaning device adapted for transforming between a stored state and a working state;

said stored state occurring while said gutter cleaning device is placed in the cavity between said sleeve and said first respective sidewall, said device making contact with the internal structure of the sleeve and sidewall;

said working state occurring while said gutter cleaning device is in use clearing debris from a gutter;

a mounting assembly connected to a pail sidewall and adapted for selectively mounting said pail on a gutter;

said gutter cleaning device including a notched recess extending from the edge of said device and located generally between said handle and head portions and adapted for avoiding a roofing material extension over a gutter;

said head portion having: a generally straight bottom surface; a generally straight rear surface; a curved forward surface; an upper-forward surface connected to the handle portion; a first, reduced material thickness located generally near the ends of said handle and head portions; and a second, greater material thickness located generally where said handle and head portions are connected;

said pail mounting assembly comprising a pair of mounting structures positioned in spaced relation on said sidewall, each said assembly including an extension element extending from the sidewall and a gripping portion depending downwardly from a respective extension element;

said mounting structures selectively receiving an external rim of said gutter;

said mounting assembly including a stabilizing bar extending laterally from said pail sidewall and adapted for engaging a gutter with said pail mounted thereon, said mounting assembly adapted for mounting said pail on the external face of the gutter.

2. The invention according to claim 1, which includes said head portion having:

a generally straight bottom surface;

a generally straight rear surface;

a curved forward surface; and an upper-forward surface connected to the handle portion.

3. The invention according to claim 1 wherein said pail includes:

a pair of opposite sidewalls each having a configuration converging on said bottom floor; and said pail having a position on a sloping roof with an upper rim thereof being generally level and said bottom for thereof being generally parallel to said roof.

4. The invention according to claim 1, which includes:

a holster mounted on a sidewall and adapted to receive said gutter cleaning device head portion in a storage position.

* * * * *